United States Patent [19]

Anchor et al.

[11] Patent Number: 4,528,075

[45] Date of Patent: Jul. 9, 1985

[54] SOLUBILIZATION OF BENZYLIDENE ACETONE IN ZINC ELECTROPLATING BATHS

[75] Inventors: Michael J. Anchor, Canton Township, Wayne County; Ronald L. Camp, Riverview, both of Mich.

[73] Assignee: BASF Wyandotte Corporation, Wyandotte, Mich.

[21] Appl. No.: 648,319

[22] Filed: Sep. 7, 1984

[51] Int. Cl.[3] ..... C25D 3/22

[52] U.S. Cl. ..... 204/55 R

[58] Field of Search ..... 204/55 R, 55 Y, 44.2, 204/114

[56] References Cited

U.S. PATENT DOCUMENTS 4,146,442 3/1979 McFarland ..... 204/55 Y
4,229,268 10/1980 Lowery et al. ..... 204/55 R

*Primary Examiner*—G. L. Kaplan
*Attorney, Agent, or Firm*—Bernhard R. Swick

[57] ABSTRACT

In accordance with the instant invention, there is provided a method for solubilizing benzylidene acetone in a zinc plating bath which comprises adding to said bath, a small amount of a Bisphenol initiated polyoxyalkylene compound.

36 Claims, No Drawings

SOLUBILIZATION OF BENZYLIDENE ACETONE IN ZINC ELECTROPLATING BATHS

BACKGROUND OF THE INVENTION

The present invention relates to solubilizing benzylidene acetone which is employed as a brightener in baths for electrodepositing zinc on a substrate and to improving zinc plating bath compositions.

In the past, many electroplating baths have been developed for providing bright zinc deposits on metallic substrates for use in many industrial applications. Such compositions generally include a brightener additive, one of the most beneficial of which is benzylidene acetone. However, such baths usually need a solubilizing compound for the benzylidene acetone. In general, high concentrations of the solubilizer are necessary, adding to the expense and in some cases interferring with the plating operation. Further they often require an excessive amount of time to solubilize the benzylidene acetone.

Accordingly, it is a purpose of the instant invention to provide a solubilizer for benzylidene acetone in a zinc plating bath which may be employed at low concentrations and which will solubilize the benzylidene acetone in a minimum amount of time, such as 30 minutes.

SUMMARY OF THE INVENTION

In accordance with the instant invention, there is provided a method for solubilizing benzylidene acetone in a zinc plating bath which comprises adding to said bath, a small amount of a Bisphenol initiated polyoxyalkylene compound. This compound is a cogeneric mixture of conjugated polyoxyalkylene compounds containing in their structure, $C_3$ to $C_5$ oxyalkylene groups, oxyethylene groups and the nucleus of a Bisphenol compound originally containing a pair of reactive hydrogen atoms. The compounds are characterized in that the $C_3$–$C_5$ oxyalkylene groups and the oxyethylene groups are present in chains which are attached to the Bisphenol compound at the site of the reactive hydrogen atoms. In a preferred embodiment of this invention, the Bisphenol initiated compound is added to the bath in admixture with the benzylidene acetone.

DETAILED DESCRIPTION OF THE PREFERRED EMBODIMENTS

In one preferred embodiment, the $C_3$–$C_5$ oxyalkylene groups are present in chains that are attached to the Bisphenol compound at the site of the reactive hydrogen atoms, therefore constituting a $C_3$–$C_5$ polyoxyalkylene polymer, the oxyethylene groups being attached to the $C_3$–$C_5$ polyoxyalkylene polymer in polyoxyethylene chains. In another preferred embodiment the polyoxyethylene groups are present in polyoxyethylene chains that are attached to the Bisphenol nucleus at the site of the reactive hydrogen atoms thereby constituting a polyoxyethylene polymer; with the $C_3$–$C_5$ oxyalkylene groups being attached to the polyoxyethylene polymer in $C_3$–$C_5$ polyoxyalkylene chains.

The alkylene oxide compound is prepared by reacting in the presence of a base catalyst a Bisphenol compound with the alkylene oxides. The Bisphenol is preferably reacted first with one alkylene oxide, then the other, such as for example reaction first with the $C_3$–$C_5$ alkylene oxide followed by reaction with ethylene oxide. The Bisphenol may alternatively be reacted first with ethylene oxide followed by the $C_3$–$C_5$ alkylene oxide depending on which product is desired. The method of preparation of a reaction product of Bisphenol with propylene oxide and ethylene oxide or butylene oxide and ethylene oxide is well known to those skilled in the art and need not be described here. Bisphenol A is the preferred initiator compound and is well known to those skilled in the art as 4,4'-isopropylidenediphenol. Bisphenol B may also be employed which is known to those skilled in the art as p,p'-sec-butylidenediphenol. Any of the conventional catalysts employed for oxyalkylation may be employed such as potassium hydroxide, sodium hydroxide, boron trifluoride dietherate and any metal oxide.

In a preferred embodiment, generally at least a portion of the Bisphenol compound is reacted with a portion of $C_3$–$C_5$ oxide or the ethylene oxide in a conventional manner to produce a Bisphenol component which is a liquid. The amount of said alkylene oxide may range from 1 to 10 moles per mole of Bisphenol A. This small amount is employed in order to have a liquid in which to carry out the reaction after which additional Bisphenol compound as well as the alkylene oxides may be added to the reaction mixture to produce the final product. The initial reaction mixture contains by weight about 1 to 95 percent of total amount of Bisphenol component, about 0.1 to 5 percent by weight catalyst and about 1 to 10 moles of alkylene oxide per mole of Bisphenol compound. The mixture is heated to a temperature of from about 100° to 135° C. After stripping for about 15 to 60 minutes at a temperature of about 95° to 125° C. at a pressure of less than 10 millimeters of mercury, the vacuum is relieved to about 0 to 5 psig with nitrogen and the remaining alkylene oxides added over a period of about 1 to 12 hours. The reaction then proceeds until a constant pressure is observed which requires from about one to four hours. As previously stated the ethylene oxide and $C_3$–$C_5$ higher alkylene oxide are preferably reacted sequentially with either the higher alkylene oxide added first followed by the ethylene oxide or vice versa. The ratios of the alkylene oxides and the Bisphenol component will depend on the ultimate product desired. For purposes of the instant invention, it is preferred to employ an alkoxylated Bisphenol product having an overall molecular weight of 1500 to 10,000 preferably to 2000 to 5000 containing about 50 to 90 percent oxyethylene groups.

The product produced by the reaction of the Bisphenol compound with the alkylene oxides is believed to be a cogeneric mixture of polymers denominated by the following formula

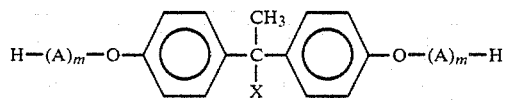

(I)

Wherein A comprises chains of oxyethylene and $C_3$–$C_5$ oxyalkylene groups; m is a whole number selected to give an overall average molecular weight of the product of 1500 to 10,000, and X is $CH_3$ or $C_2H_5$.

In a preferred embodiment of the invention, A comprises oxyethylene groups and groups selected from oxypropylene and oxybutylene wherein the oxyethylene groups are attached to the oxygen that is attached to a phenyl group and the oxypropylene or oxybutylene groups are attached to the opposite end of the oxyethylene groups. In another preferred embodiment, A comprises oxyethylene groups and groups selected from oxypropylene and oxybutylene groups wherein said oxypropylene or oxybutylene groups are attached to the oxygen that in turn is attached to a phenyl group and the oxyethylene groups are attached to the opposite end of the oxypropylene or oxybutylene groups. The molecular weight of the final product is from about 1500 to 10,000. The percentage of oxyethylene groups in these compounds is from about 50 to 90. Accordingly, the preferred oxyalkylated Bisphenol compound employed in the instant invention is believed to be a cogeneric mixture of polymers denominated by the following formulas:

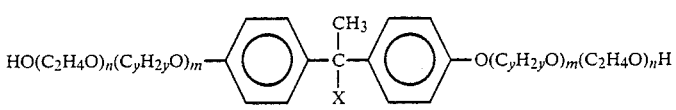

(II)

and

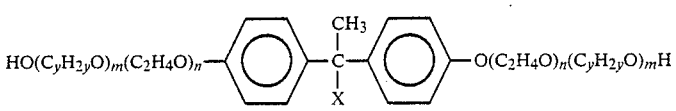

(III)

Wherein x is $CH_3$ or $C_2H_5$, y is 3 or 4, m and n are whole numbers selected to give an overall molecular weight from about 1500 to 10,000 and a percent of oxyethylene groups from about 50 to 90. The oxybutylene chains optionally but advantageously contain small amounts of oxyethylene and oxypropylene groups, the oxypropylene chains optionally, but advantageously, contain small amounts of oxyethylene and oxybutylene groups and the oxyethylene chains also optionally, but advantageously, contain small amounts of oxypropylene and oxybutylene groups. These compositions are more particularly described in the U.S. Pat. Nos. 2,677,700, 2,674,619, and 2,979,528. The term "cogeneric mixture" used herein is a term that has been coined to designate a series of closely related touching homologues that are obtained by condensing a plurality of alkylene oxide units with a reactive hydrogen compound (see U.S. Pat. No. 2,549,438, particularly the sections beginning at column 12, line 40). This expression is well known to those skilled in the art as can be seen from U.S. Pat. Nos. 2,677,700; 2,674,619; and 2,979,528.

The plating baths of the invention contain free zinc ions and are prepared with water soluble zinc salts such as zinc chloride, zinc sulphate, zinc fluoroborate, zinc acetate and/or zinc sulfonate. The zinc ion concentration in the plating baths of the invention may vary over a wide range such as from about 15 to about 75 grams per liter and preferably from about 22 to about 55 grams per liter.

The concentration in the plating baths of the invention of the oxyalkylated Bisphenol compound is at least about 0.4 grams per liter. The maximum amount is dictated only by economics. Generally the amount would not exceed 100 grams per liter. The concentration of the benzylidene acetone is from about 0.1 to 5.0 grams per liter.

The plating baths of the invention may also contain conductive salts or compounds capable of forming soluble complexes with zinc. The salts generally include ammonium salts or salts of alkali metals such as sodium and potassium including the sulphates, chlorides, fluoborates, and acetates either alone or in combination. It is generally preferred that the plating bath of the invention contain from about 100 to 250 grams per liter of chloride ion. Alkali metal chlorides or ammonium chlorides in combination with zinc chloride as the zinc compound are preferred in the preparation of baths of the invention. Where a zinc compound other than zinc chloride is employed, it is preferred to include a conductive chloride salt to provide chloride ions and conversely with a complexing compound or conductive salt that is not a chloride, it is preferred to employ zinc chloride as the zinc compound.

In one preferred embodiment of the invention boric acid is also included in the plating baths of the invention. Boric acid serves as a weak buffer to control pH and cathode film. The boric acid is also helpful in smoothing the zinc deposit and is believed to have a cooperative effect with the leveling agents included in the baths of the invention. The concentration of boric acid in the baths of the invention is not critical and generally will be in a range from about 0 to about 60 grams per liter, preferably from about 5 to 30 grams per liter.

The baths of this invention may also contain beta naphthol oxyethylate in amount of about 5 to 50 grams per liter. Other additives conventionally employed in zinc plating baths may be incorporated into the baths of the instant invention, generally in amounts of about 5 to 300 grams per liter. Such other additives include Surfynol 465 (tetramethyl decynediol ethoxylated with 65 percent by weight ethylene oxide), sodium or potassium salt of tetrahydro naphthalene sulfonic acid, sodium salt of a sulfonated naphthalene condensate, a reaction product of naphthol reacted with 12 to 20 moles of ethylene oxide, sodium or potassium salt of benzoic acid, sodium or potassium salt of salicylic acid, methylchloro benzaldehyde, polyethyleneimine, sorbitan monooleate oxyethylated with about 5 to 100 moles of ethylene oxide, various other surfactants such as anionic, nonionic, and cationic surfactants. In accordance with a most preferred embodiment, sodium or potassium benzoate is employed in amount of about 2 to 8 grams per liter, oxyethylated sorbitan monooleate is employed in amount of about 15 to 25 grams and the other surfactants are employed in amount of about 2 to 8 grams per liter.

The invention will now be further illustrated by the following examples of electroplating with solutions according to the instant invention wherein all parts are by weight unless otherwise indicated.

In all of the baths of the following examples 1 to 10 testing was undertaken utilizing a conventional 267 ml Hull cell. The bath was agitated and the temperature was room temperature, i.e., about 22° to 24° C. Clear solutions were obtained. The cloud point of the final solution is important to the consumers of these products. If the temperature rises above the cloud point of the plating bath, the brightener additive, i.e., the benzylidene acetone, will come out of solution and render the bath ineffective. This concerns the consumer especially in the summer since the baths generally do not have a cooling capability.

The cloud point was determined by first preparing a bulk solution of the test zinc electrolyte. A portion of benzylidene acetone and the solubilizer to be tested was weighed into a container. The zinc electrolyte was weighed into the same container and the mixture agitated until the solution was clear. The container was then placed in an apparatus that is equipped with a mechanical stirring device and a thermometer. The solution was then heated to a point where it was completely opaque and the temperature noted at this point. This is designated the cloud point.

EXAMPLE 1

An aqueous electroplating bath was prepared containing, per liter, 100.8 grams of zinc chloride, 179.2 grams of ammonium chloride, 6.0 grams of sodium benzoate, and 1 percent by weight of Dowfax 2Al,(45 percent aqueous solution of sodium, mono- and didodecyl disulfonated diphenyl oxide). A mixture of 5.0 grams of a Bisphenol-A initiated polyoxypropylene polyoxyethylene block copolymer, herein designated as polymer No. 1, of the type shown in formula II above having a total molecular weight of 4750 and containing 80 percent by weight oxyethylene groups, and 1.33 grams of benzylidene acetone was added to the electroplating bath. The above-stated amounts of said copolymer and benzylidene acetone are per liter of the final electroplating bath. The Hull cell was operated at 1 amp of current for five minutes. The zinc deposited on the cathode was bright over a current density range of from 0.5 to 40 amps/sq.ft. The cloud point was 47° C.

EXAMPLE 2

An aqueous electroplating bath was prepared as described in Example 1 containing per liter 100.8 grams of zinc chloride, 179.2 grams of ammonium chloride, 6.0 grams of sodium benzoate, 1.33 grams of benzylidene acetone, and 5.0 grams of a Bisphenol-A initiated polyoxypropylene polyoxyethylene block copolymer of the type shown in formula II above having a total molecular weight of 8750 and containing 80 percent by weight oxyethylene groups.

The Hull cell was operated at 1 amp current for five minutes. The zinc deposit on the cathode was very bright from 0.2 to 40 amps/ft$^2$. The cloud point was 41° C.

EXAMPLE 3

An aqueous electroplating bath was prepared, as described in Example 1, containing per liter 100.8 grams of zinc chloride, 3 grams of Polymin G-20+EO, 179.2 grams of ammonium chloride, 1.33 grams of benzylidene acetone, 6.0 grams of sodium benzoate, 5 grams of polyol No. 1, and 0.25 percent by weight of Dowfax 2Al surfactant solution. Another composition was made up the same as just described with the exception that 1 percent of the Dowfax 2Al surfactant solution was substituted for 0.25 percent. In both cases the zinc deposited on the cathode was very bright over a current density range of from 0.2 to 40 amps/sq.ft. in a Hull cell operated under 1 amp of current for five minutes. The cloud point of the first example was 42° C. and the second was not taken.

EXAMPLE 4

An aqueous electroplating bath was prepared, as described in Example 1, containing per liter 100.8 grams zinc chloride, 179.2 grams ammonium chloride, 6.0 grams sodium benzoate, 1.33 grams of benzylidene acetone and 30 grams of polymer No. 1.

The Hull cell was operated at 1 amp for 10 minutes under which conditions the zinc deposited on the cathode was bright over a current density range of 0.2 to 3 amps per square foot with the remainder having a very slight haze over a range of 3 to 40 amperes per square foot.

When the Hull cell was operated under 3 amps of current for ten minutes, the zinc deposited on the cathode was slightly hazy for over a current density range of from 20 to 18 amps per square foot with the remainder hazy. The cloud point was 47° C.

EXAMPLE 5

An aqueous electroplating bath was prepared, as described in Example 1, containing per liter 22.5 grams of zinc chloride, 150 grams of ammonium chloride, 4 grams of sodium benzoate, 1.33 grams of benzylidene acetone, and 30 grams of polymer No. 1. With the Hull cell operated at 1 amp current for ten minutes, the zinc deposited on the cathode had a very, very slight haze over a current density range of from 0.2 to 40 amps per square foot.

With the Hull cell operated at 3 amps over a period of ten minutes, the zinc deposited on the cathode showed very, very slight haze throughout a 40 to 120 amps per square foot range. The cloud point was 65° C.

EXAMPLE 6

An aqueous electroplating bath was prepared, as described in Example 1, containing per liter 22.5 grams of zinc chloride, 150 grams of ammonium chloride, 4 grams of sodium benzoate, 1.33 grams of benzylidene acetone, 20 grams of sorbitan monooleate ethoxylated with 20 moles of ethylene oxide and 5 grams of polymer No. 1. The Hull cell was operated under 1 amp of current for ten minutes, the zinc deposited on the cathode was bright over a current density range of 0 to 8 amps per square foot with very slight haze over a current density range of 8 to 40 amps per square foot.

With the Hull cell operated at 3 amps for ten minutes, the zinc deposited on the cathode was bright over a current density range of 0.2 to 18 amps per square foot. The cloud point was 59° C.

EXAMPLE 7

An aqueous electroplating bath was prepared, as described in Example 1, containing per liter 100.8 grams of zinc chloride, 179.2 grams of ammonium chloride, 6 grams of sodium benzoate, 1.33 grams of benzylidene acetone, 3 grams of sorbitan monooleate ethoxylated with 20 moles of ethylene oxide and 5 grams of polymer No. 1.

When the Hull cell was operated under 1 amp of current for ten minutes, the zinc deposited on the cathode was bright over a current density range of 0.2 to 40 amps per square foot, and when the Hull cell was operated under 3 amps of current for ten minutes, the zinc deposited on the cathode was bright over a current density range of from 0.2 to 75 amps per square foot. The cloud point was 46° C.

EXAMPLE 8

An aqueous electroplating bath was prepared, as described in Example 1, containing per liter 100.8 grams of zinc chloride, 172.9 grams of ammonium chloride, 6.0 grams of sodium benzoate, 30 grams of polymer No. 1, 5 grams of an ethylenediamine initiated polyoxypropylene polyoxyethylene block copolymer wherein the polyoxypropylene blocks are attached at the sites of the active hydrogen groups of the ethylenediamine and the oxyethylene groups are attached at the opposite ends of the oxypropylene groups which compound is a nonionic surfactant having a molecular weight of the polyoxypropylene groups of 1500 to 2000 and containing 40 percent oxyethylene groups, and 1.33 grams of benzylidene acetone.

With the Hull cell operated under 1 amp of current for ten minutes, the zinc deposited on the cathode was very bright over a current density range of 1 to 40 amps per square foot. The cloud point was 52° C.

EXAMPLE 9

An aqueous electroplating bath was prepared, as described in Example 1, containing per liter 100.8 grams of zinc chloride, 172.9 grams of ammonium chloride, 6 grams of sodium benzoate, 1.33 grams of benzylidene acetone, 5 grams of the oxypropylated oxyethylated diamine block copolymer of Example 8 and 5 grams of polymer No. 1.

With the Hull cell operated under 1 amp of current for ten minutes, the zinc deposited on the cathode was very bright over a current density range of 1 to 40 amps per square foot. With the Hull cell operated under 3 amps of current for ten minutes, the zinc deposited on the cathode was bright over a current density range of 0 to 120 amps per square foot. The cloud point was 37° C.

EXAMPLE 10

An aqueous electroplating bath was prepared, as described in Example 1, containing per liter 100.8 grams of zinc chloride, 179.2 grams of ammonium chloride, 6 grams of sodium benzoate, 1.3 grams of benzylidene acetone, 30 grams of a sorbitan monooleate ethoxylated with 20 moles of ethylene oxide, and 30 grams of polymer No. 1.

With the Hull cell operated under 1 amp of current for ten minutes, the zinc deposited on the cathode was very bright over a current density range of 1 to 40 amps per square foot. The cloud point was 53° C.

EXAMPLE 11

An aqueous electroplating bath was prepared containing per liter 50.0 grams zinc chloride, 140.0 grams potassium chloride, 20 grams boric acid, 1.33 grams of benzylidene acetone and 7 grams of polymer No. 1. The cloud point was 50° C.

EXAMPLE 12

An aqueous electroplating bath is prepared as described in Example 1 with the exception that the block copolymer is a polyoxypropylene polyoxyethylene polymer of the type shown in Formula III above wherein total molecular weight is 4500 and the percent oxyethylene groups is 80. The bath is clear or very slightly hazy and gives good plating results over a wide range of current densities. When used for electroplating, a bright zinc deposit is achieved.

EXAMPLE 13

An aqueous electroplating bath is prepared as described in Example 1 with the exception that the block copolymer is a polyoxybutylene polyoxyethylene polymer of the type shown in Formula II above wherein total molecular weight is 3750 and the percent oxyethylene groups is 85. The bath is clear or very slightly hazy and gives good plating results over a wide range of current densities. When used for electroplating, a bright zinc deposit is achieved.

EXAMPLE 14

An aqueous electroplating bath is prepared as described in Example 1 with the exception that the block copolymer is a polyoxybutylene polyoxyethylene polymer of the type shown in Formula III above wherein total molecular weight is 4900 and the percent oxyethylene groups is 76. The bath is clear or very slightly hazy and gives good plating results over a wide range of current densities. When used for electroplating, a bright zinc deposit is achieved.

The embodiments of the invention in which an exclulsive privilege or property is claimed are defined as follows:

1. An aqueous electroplating bath for depositing zinc comprising zinc ions, benzylidene acetone, and an oxyalkylene compound which is a cogeneric mixture of conjugated polyoxyalkylene compounds containing in their structure $C_3$–$C_5$ oxyalkylene groups, oxyethylene groups and the nucleus of a Bisphenol compound containing a plurality of reactive hydrogen atoms.

2. The electroplating bath of claim 1 including additional additives.

3. The aqueous electroplating bath of claim 1 comprising about 15 to 75 grams per liter of zinc ions, about 0.1 to 5 grams per liter of benzylidene acetone, and at least about 0.4 grams per liter of said Bisphenol initiated compound.

4. The zinc plating bath of claim 3 including additional additives in total amount of about 5 to 300 grams per liter.

5. The zinc plating bath of claim 3 wherein said Bisphenol initiated compound has a total molecular weight of about 1500 to 10,000 and contains about 50 to 95 percent by weight oxyethylene groups.

6. The zinc plating bath of claim 5 including about 5 to 300 grams per liter of additional additives.

7. The zinc plating bath of claim 3 wherein said Bisphenol initiated compound contains in its structure oxyethylene groups and groups selected from oxybutylene and oxypropylene groups and a nucleus of Bisphenol A containing a plurality of reactive hydrogen atoms; the compounds being characterized in that all of the oxybutylene or oxypropylene groups are present in chains that are attached to the Bisphenol A nucleus at the site of the reactive hydrogen atoms; the oxyethylene groups being attached to the polyoxybutylene or polyoxypropylene groups at the end opposite the end of said latter groups which are attached to the Bisphenol A nucleus.

8. The zinc plating bath of claim 7 containing 5 to 300 grams per liter of additional additives.

9. The electroplating bath of claim 1 including a complexing agent.

10. The electroplating bath of claim 9 including additional additives.

11. The electroplating bath of claim 9 including beta naphthol oxyethylate.

12. The electroplating bath of claim 11 including additional additives.

13. The electroplating bath of claim 9 comprising by weight about 15 to 75 grams per liter of zinc ions, about 0.1 to 5 grams per liter of benzylidene acetone, at least about 0.4 grams per liter of said Bisphenol initiated polyoxyalkylene compound, 0 to about 250 grams per liter of said complexing agent, and 0 to about 40 grams per liter of beta naphthol oxyethylate.

14. The zinc plating bath of claim 13 including additional additives in total amount of about 15 to 300 grams per liter.

15. The zinc plating bath of claim 13 wherein said Bisphenol initiated compound has a total molecular weight of about 1500 to 10,000 and contains about 50 to 95 percent by weight oxyethylene groups.

16. The zinc plating bath of claim 15 including about 5 to 35 grams per liter of boric acid.

17. The zinc plating bath of claim 15 including about 5 to 300 grams per liter of additional additives.

18. The zinc plating bath of claim 17 wherein said additional additives are selected from the group consisting of sodium benzoate, oxyethylated sorbitan monooleate and ethylenediamine initiated polyoxypropylene polyoxyethylene block copolymers and mixtures thereof.

19. The zinc plating bath of claim 18 wherein said additional additives are about 2 to 8 grams per liter of sodium benzoate and about 15 to 25 grams per liter of sorbitan monooleate oxyethylated with about 5 to 100 moles of ethylene oxide.

20. The zinc plating bath of claim 18 wherein said additional additives are about 2 to 8 grams per liter of sodium benzoate and about 2 to 8 grams per liter of an ethylenediamine initiated polyoxyethylene-polyoxybutylene block copolymer wherein the polyoxypropylene blocks are attached at the sites of the active hydrogen groups of the ethylenediamine and the oxyethylene groups are attached at the opposite ends of the oxypropylene groups which compound is a nonionic surfactant having a molecular weight of the polyoxypropylene groups of about 500 to 3000 and containing 30 to 50 percent oxyethylene groups.

21. The zinc plating bath of claim 15 wherein said Bisphenol initiated compound contains in its structure oxypropylene groups, oxyethylene groups and a nucleus of Bisphenol A containing a plurality of reactive hydrogen atoms; the compounds being characterized in that all of the oxypropylene groups are present in polyoxypropylene chains that are attached to the Bisphenol A nucleus at the site of the reactive hydrogen atoms; the oxyethylene groups being attached to the polyoxypropylene groups at the end opposite the end of said polyoxypropylene groups which are attached to the Bisphenol A nucleus.

22. The zinc plating bath of claim 21 including about 5 to 35 grams per liter of boric acid.

23. The zinc plating bath of claim 21 containing about 5 to 300 grams per liter of additional additives.

24. The zinc plating bath of claim 23 wherein said additional additives are selected from the group consisting of sodium benzoate, oxyethylated sorbitan monooleate and ethylenediamine initiated polyoxypropylene-polyoxyethylene block copolymers and mixtures thereof.

25. The zinc plating bath of claim 24 wherein said additional additives are about 2 to 8 grams per liter of sodium benzoate and about 15 to 25 grams per liter of sorbitan monooleate oxyethylated with about 5 to 100 moles of ethylene oxide.

26. The zinc plating bath of claim 24 wherein said additional additives are about 2 to 8 grams per liter of sodium benzoate and about 2 to 8 grams per liter of an ethylenediamine initiated polyoxypropylene-polyoxyethylene block copolymer wherein the polyoxypropylene blocks are attached at the sites of the active hydrogen groups of the ethylenediamine and the oxyethylene groups are attached at the opposite ends of the oxypropylene groups which compound is a nonionic surfactant having a molecular weight of the polyoxypropylene groups of about 500 to 3000 and containing 30 to 50 percent oxyethylene groups.

27. The zinc plating bath of claim 15 wherein said Bisphenol initiated compound contains in its structure oxypropylene groups, oxyethylene groups and a nucleus of Bisphenol A containing a plurality of reactive hydrogen atoms; the compounds being characterized in that all of the oxyethylene groups are present in polyoxyethylene chains that are attached to the Bisphenol A nucleus at the site of the reactive hydrogen atoms; the oxypropylene groups being attached to the polyoxyethylene groups at the end opposite the end of said polyoxyethylene groups which are attached to the Bisphenol A nucleus.

28. The zinc plating bath of claim 27 containing 5 to 300 grams per liter additional additives.

29. The zinc plating bath of claim 15 wherein said Bisphenol initiated compound contains in its structure oxybutylene groups, oxyethylene groups and a nucleus of Bisphenol A containing a plurality of reactive hydrogen atoms; the compounds being characterized in that all of the oxybutylene groups are present in polyoxybutylene chains that are attached to the Bisphenol A nucleus at the site of the reactive hydrogen atoms; the oxyethylene groups being attached to the polyoxybutylene groups at the end opposite the end of said polyoxybutylene groups which are attached to the Bisphenol A nucleus.

30. The zinc plating bath of claim 29 containing 5 to 300 grams per liter additional additives.

31. The zinc plating bath of claim 15 wherein said Bisphenol initiated compound contains in its structure oxybutylene groups, oxyethylene groups and a nucleus of Bisphenol A containing a plurality of reactive hydrogen atoms; the compounds being characterized in that all of the oxyethylene groups are present in polyoxyethylene chains that are attached to the Bisphenol A nucleus at the site of the reactive hydrogen atoms; the oxybutylene groups being attached to the polyoxyethylene groups at the end opposite the end of said polyoxyethylene groups which are attached to the Bisphenol A nucleus.

32. The zinc plating bath of claim 31 containing 5 to 300 grams per liter additional additives.

33. A method for solubilizing benzylidene acetone in a zinc plating bath comprising adding to said bath at least about 0.4 grams per liter of a Bisphenol initiated polyoxyalkylene compound which is a cogeneric mixture of conjugated polyoxyalkylene compounds containing in their structure $C_3$–$C_5$ oxyalkylene groups, oxyethylene groups and the nucleus of a Bisphenol compound containing a plurality of reactive hydrogen atoms.

34. The method of claim 33 wherein the zinc plating bath is an aqueous bath comprising about 15 to 75 grams per liter of zinc ions, about 0.1 to 5.0 grams per liter of benzylidene acetone, and at least about 0.4 grams per liter of said Bisphenol initiated compound.

35. The method of claim 34 wherein said Bisphenol initiated compound has a total molecular weight of about 1500 to 10,000 and contains about 50 to 95 percent by weight oxyethylene groups.

36. The method of claim 35 wherein said Bisphenol initiated compound and said benzylidene acetone are mixed together prior to their addition to said plating bath.

* * * * *